US005513509A

United States Patent [19]

Bergen

[11] Patent Number: 5,513,509

[45] Date of Patent: May 7, 1996

[54] KEY FOR USE WITH 5-PIN AND 6-PIN DOOR LOCKS

[75] Inventor: Gary R. Bergen, Yorba Linda, Calif.

[73] Assignee: Emhart Inc., Newark, Del.

[21] Appl. No.: 210,532

[22] Filed: Mar. 18, 1994

Related U.S. Application Data

[63] Continuation of Ser. No. 928,601, Aug. 13, 1992, abandoned.

[51] Int. Cl.[6] ..... E05B 19/06

[52] U.S. Cl. ..... 70/409; 70/406; 70/337; 70/367; 70/370; 70/493

[58] Field of Search ..... 70/409, 393, 337, 70/344, 340, 402, 406, DIG. 37, 493, 367, 370

[56] References Cited

U.S. PATENT DOCUMENTS

| | | | |
|---|---|---|---|
| 1,009,155 | 11/1911 | Kohlberger . | |
| 1,679,558 | 8/1928 | Best | 70/393 |
| 1,953,535 | 4/1934 | Hurd . | |
| 2,807,158 | 9/1957 | Best . | |
| 2,910,860 | 11/1959 | Camba . | |
| 3,167,943 | 2/1965 | Schreiber et al. . | |
| 3,348,392 | 10/1967 | Schreiber . | |
| 3,349,587 | 10/1967 | Keller | 70/406 |
| 3,418,833 | 12/1968 | Kerr . | |
| 3,788,110 | 1/1974 | Sugae . | |
| 4,075,879 | 2/1978 | Christopher . | |
| 4,162,623 | 7/1979 | Yorio et al. | 70/409 |

FOREIGN PATENT DOCUMENTS

| | | | |
|---|---|---|---|
| 3707313 | 9/1988 | Germany | 70/393 |
| 8908761 | 9/1989 | WIPO . | |

*Primary Examiner*—Darnell M. Boucher
*Attorney, Agent, or Firm*—Spencer T. Smith

[57] ABSTRACT

A key 20 is formed with a blade 22 having six bits 30, 32, 34, 36, 38 and 40 formed along one edge of the blade. A shoulder 42 is formed on a trailing end 28 of blade 22 and is positioned to cooperate with a front face 82 of a plug 50 of a five-pin cylinder lock 46 to locate bits 30, 32, 34, 36 and 38 adjacent five respective sets of tumbler pins in the operation of the lock. Key 20 can also be used with a six-pin cylinder lock 110. Shoulder 42 is moved through a slot 130 in a front face 134 of a plug 114 of lock 110 and engages a stop surface 132 whereby bits 30, 32, 34, 36, 38 and 40 are properly positioned adjacent six respective sets of tumbler pins in the operation of the lock.

3 Claims, 4 Drawing Sheets

KEY FOR USE WITH 5-PIN AND 6-PIN DOOR LOCKS

This is a Continuation of application Ser. No. 07/928,601, filed Aug. 13, 1992, now abandoned.

BACKGROUND OF THE INVENTION

This invention relates to a key which can be used with a 5-pin door lock and a 6-pin door lock and particularly relates to a key which is designed to facilitate the operation of cylinder locks which use either a five tumbler pin arrangement or a six tumbler pin arrangement.

Cylinder locks include a plug which is rotatably inserted into a cylinder. The plug is formed with a key slot which extends in an axial direction through the plug. A plurality of pin holes are formed in the cylinder in alignment with a corresponding plurality of pin holes in the plug. Both the cylinder holes and the plug holes are formed transverse to the axis of the cylinder and plug. Each set of aligned holes of the cylinder and plug contain at least a pair of tumbler pins and a spring which normally urges the pins axially toward the axis of the cylinder and plug.

Normally, the pins are situated within the aligned holes so that they straddle the adjacent juncture of the plug and cylinder and thereby prevent the plug from being turned relative to the cylinder. In this manner, the plug and cylinder provide a locking arrangement which is commonly used in assembly with doors.

A key is formed selectively with a plurality of stepped surfaces along one edge thereof where such surfaces are referred to as bits. Each bit represents a level within the key slot of the plug at which the aligned pins associated therewith must be moved to locate the juncture of the pins in alignment with the juncture of the plug and cylinder. When all such sets of pins are so aligned at the juncture of the cylinder and plug, commonly referred to as the shear line, the plug may be rotated within the cylinder to unlock the cylinder lock and to permit operation of a related door latch facility.

In the past, the plug and the cylinder of each lock were each formed with five holes for receipt of pins therein. Various combinations and arrangements of pins could be selected for each set of aligned holes for each lock thereby providing a multitude of possible combinations, each requiring a bit configuration for the associated key which was different from the keys of the remaining combinations. The use of locks with the arrangement of five holes provided reasonable security for the ultimate user of such an arrangement and many such locks are currently installed in the facilities and residences of the users. To avoid the necessity for multiple keys for the locks of a single facility or residence, the manufacturer provided sets of locks, all of which could be operated by a single key.

To enhance the security provision of a cylinder lock, a six-hole lock was introduced to expand the number of possible combinations of pins within the locks.

On occasion, the owner of a facility or residence, having the five-pin locks previously installed in their facility, may wish to upgrade some but not all of the five-pin locks to six-pin locks. In such instance, the user would then have at least two keys required to operate the cylinder locks at the user's facility. This is a distinct disadvantage to the user.

Thus, there is a need for a system which will permit the use of five-pin locks and six-pin locks in the same facility and be able to operate both types of locks with a single key.

SUMMARY OF THE INVENTION

In light of the need expressed above, it is an object of this invention to provide a key which can be used with five-pin and six-pin cylinder locks.

With this and other objects in mind, this invention contemplates a key for use with a first plug and a second plug. The first plug has a key slot formed in an outer key-insertion face of and through the first plug which supports a first prescribed number of sets of tumbler pins. The second plug has a key slot formed in an outer key-insertion face of and through the second plug which supports a second prescribed number of sets of tumbler pins equal to the sum of the first prescribed number plus at least one additional set of tumbler pins. The key includes a key blade having an insert end and a trailing end. A first prescribed number of bits are formed along an edge of the key blade equal in number to the first prescribed number of sets of tumbler pins and located between the insert end and the trailing end of the key blade. At least one additional bit is formed along the edge of the key blade adjacent the first prescribed number of bits and is located between the insert end and the trailing end of the key blade. The insert end of the key blade is initially insertible into the key slots of the first and second plugs at the key-insertion face thereof. A structural surface is formed on the key adjacent the trailing end of the key blade with respect to the first prescribed number of bits for engaging a portion of the key-insertion face of the first plug to facilitate positioning of the first prescribed number of the bits in alignment with respective ones of the first prescribed number of sets of tumbler pins. The structural surface which is formed on the key adjacent the trailing end of the key blade is located with respect to the first prescribed number of bits and the one additional bit for engaging a portion of the second plug to facilitate positioning of the one additional bit adjacent the one additional set of tumbler pins and to facilitate simultaneous positioning of the first prescribed number of bits with the remainder of the second prescribed number of tumbler pins.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
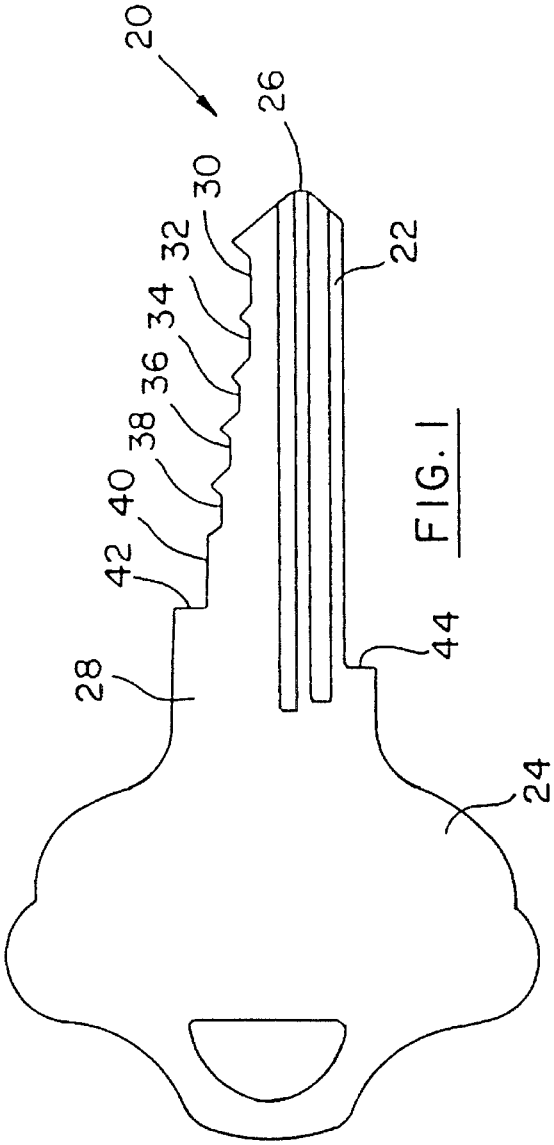
FIG. 1 is a side view of a key showing a blade positioning surface in accordance with certain principles of the invention.

As shown in FIG. 1, a key 20 is formed with a blade 22 and a bow 24. Blade 22 is formed with an insert end 26 and a trailing end 28. Six bits 30, 32, 34, 36, 38 and 40 are formed along one edge of blade 22 in serial fashion and extend from insert end 26 to trailing end 28. Trailing end 28 of blade 22 is wider than the portion of the blade which contains bits 30, 32, 34, 36, 38 and 40. With the wider trailing end 28, two shoulders 42 and 44 are formed at the trailing end on opposite edges of blade 22. Shoulder 42 forms a structural surface of key 20. It is noted that shoulder 42 is formed in an edge of blade 22 which includes bits 30, 32, 34, 36, 38 and 40 well forward of bow 24 while shoulder 44 is formed on the opposite edge of the blade at a location closer to the bow. Thus, shoulders 42 and 44 are spaced apart in an axial direction.

Figure 3:
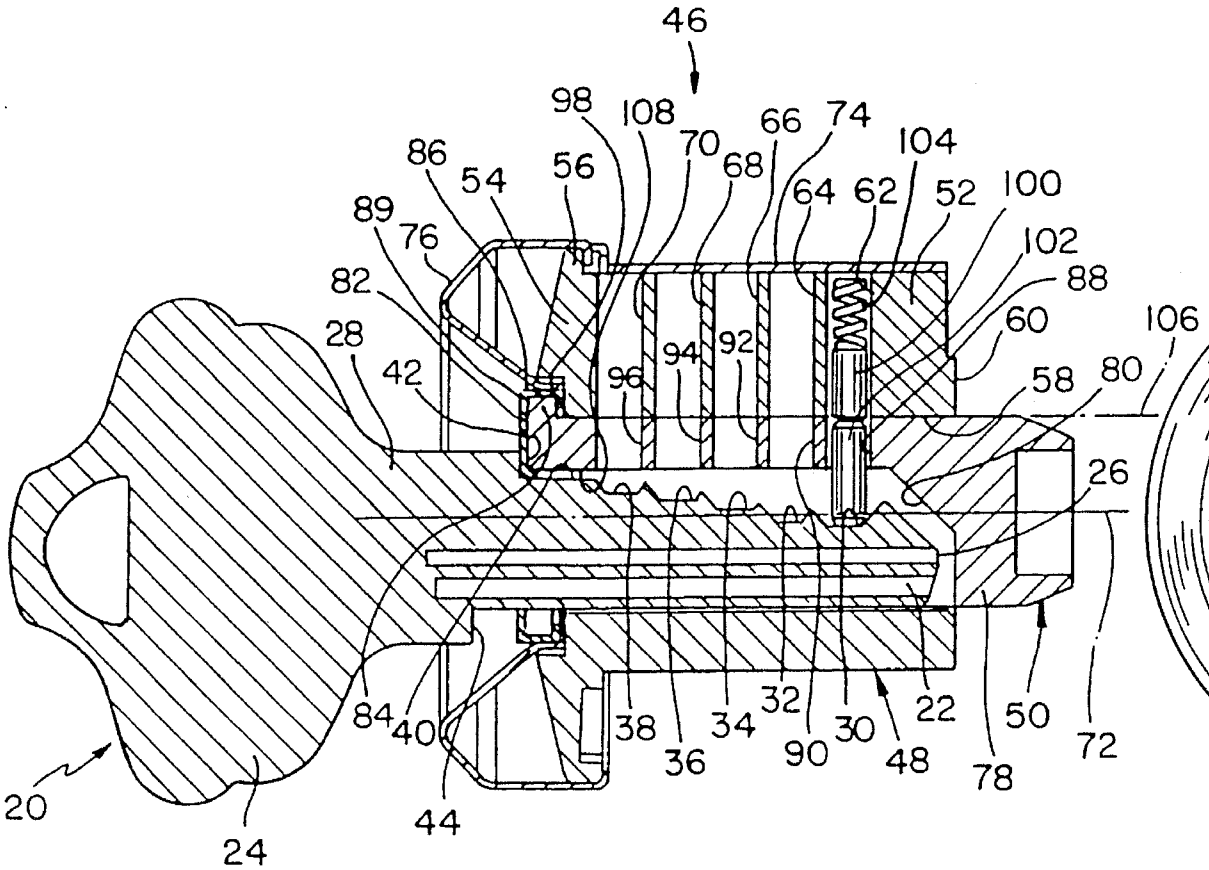
FIG. 3 is a sectional view taken along line 3—3 of FIG. 2 of the cylinder lock of FIG. 2 showing the key of FIG. 1 in assembly with a plug of the cylinder lock in accordance with certain principles of the invention.

Referring to FIG. 3, there is shown a cylinder lock 46 which is formed by a cylinder 48 and a plug 50. Cylinder 48 is formed with a main body 52 and a front section 54 with a flange 56. Cylinder 48 is also formed with a central opening 58 which extends through body 52 from front section 54 through a rear face 60. Body 52 is formed with five holes 62, 64, 66, 68 and 70 which extend generally radially toward an axis 72 of opening 58. A cover 74 is to be placed over the outboard end of holes 62, 64, 66, 68 and 70 in a later operation. A decorative cover 76 is placed over the outboard face of front section 54 of cylinder 48.

Figure 2:
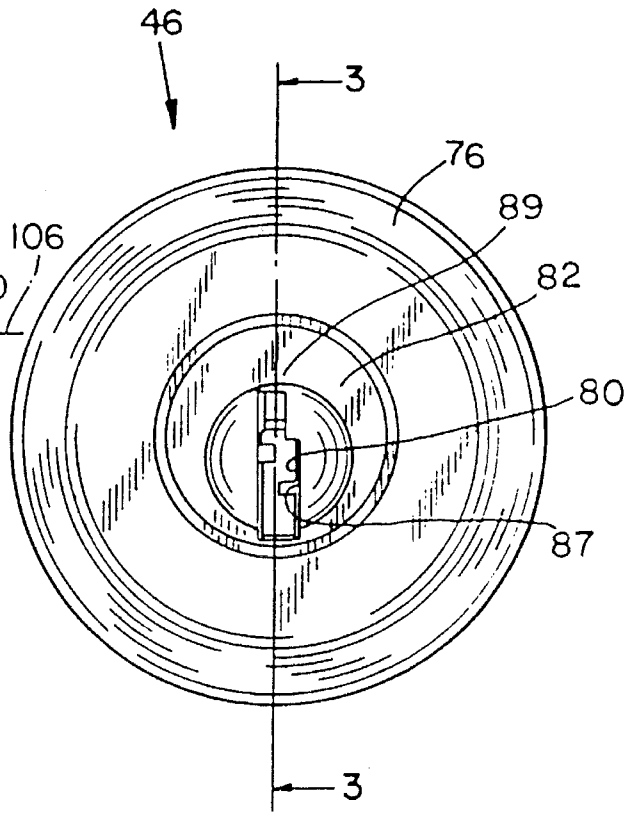
FIG. 2 is a front view of a five-pin cylinder lock.

Plug 50 is formed with a body 78 having a key slot 80 formed therein in an axial direction. The exterior of body 78 is round and is dimensioned to be positioned within central opening 58 of cylinder body 52. The outboard end of plug 50 is formed with a front face 82 and a circular flange 84. A decorative cover 86 is designed to fit over the front face 82 of plug 50 and to be crimped behind flange 84 and, together with cylinder cover 76 provides a decorative appearance for the outboard portions of cylinder lock 46 in its assembly with an operator such as a door knob (not shown). Cover 86 is formed with a rectangular window 87 (FIG. 2) which reveals key slot 80.

Plug 50 is also formed with five holes 88, 90, 92, 94 and 96 which extend axially thereof through body 78 from the outer periphery thereof to key slot 80. When plug 50 is inserted in central opening 58, the plug can be moved axially into the opening until flange 84 is positioned adjacent a shoulder stop surface 98 formed in front section 54 of the cylinder 48. In this position, holes 88, 90, 92, 94 and 96 of the plug align with holes 62, 64, 66, 68 and 70, respectively, of cylinder 48.

With cover 74 unassembled, at least two tumbler pins and a spring are assembled into each aligned set of cylinder and plug holes. For example, two pins 100 and 102 and a compression spring 104 are deposited into aligned holes 62 and 82. After two pins and one compression spring have been inserted into each of the five sets of aligned holes in accordance with a selected combination, cover 74 is attached to the top of body 52 to cover the top of holes 62, 64, 66, 68 and 70 and thereby prevent the springs and pins from moving out of the holes.

It is noted that the lengths of the pairs of tumbler pins in the respective aligned holes of cylinder 48 and plug 50 are selected to establish one of many combinations for such cylinder locks. When the facing ends of each pair of pins are aligned with a line 106, which is referred to as "the shear line," plug 50 can be rotated within central opening 58 of cylinder 48. Otherwise, some portion of one of the pins in each of the sets of aligned holes of cylinder 48 and plug 50 will be located on the shear line 106 and will preclude rotation of the plug within central opening 58.

When blade 22 of key 20 is inserted through window 87 and into key slot 80, the key is moved until key shoulder 42 engages a face portion 89 of cover 86 which is backed by front face 82 of plug 50. At this time, blade 22 of key 20 is fully inserted into key slot 80 and the bits 30, 32, 34, 36 and 38 have positioned the pairs of tumbler pins within the five sets of aligned holes so that the facing ends of each set is located on the shear line. The key 20 can now be turned to turn plug 50 and unlock a related locking mechanism (not shown).

It is noted that while the arrangement of the cylinder 48 and plug 50 involves five sets of pins, key 20 has six bits. Five bits 30, 32, 34, 36 and 38 are utilized to position the five sets of aligned pins as illustrated in FIG. 3. The sixth bit 40 is located adjacent and faces a blank surface 108. It is also noted that shoulder 42 of key 20 cooperates with portion 89 of cover 86 and the front face 82 of plug 50 to position the five bits 30, 32, 34, 36 and 38 as described above.

Figure 5:
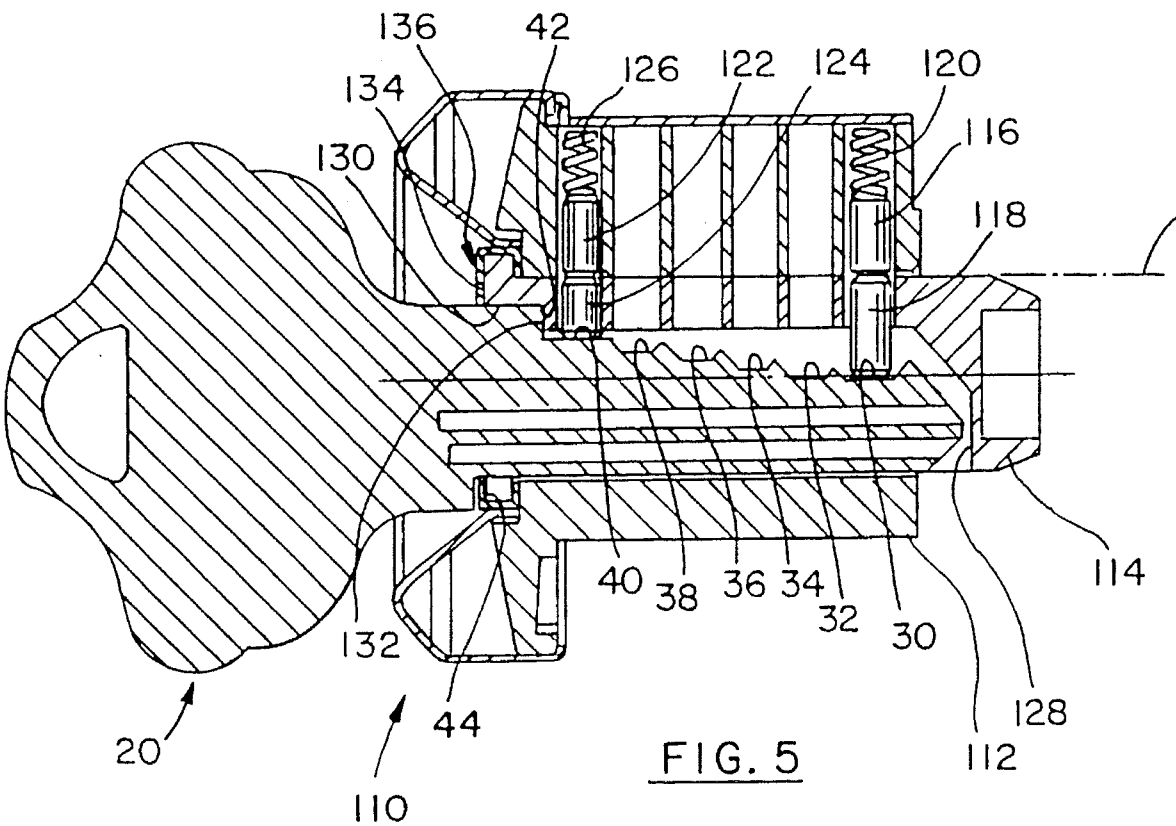
FIG. 5 is a sectional view taken along line 5—5 of FIG. 4 of the cylinder lock of FIG. 4 showing the key of FIG. 1 in assembly with a plug of the cylinder lock in accordance with certain principles of the invention.

As shown in FIG. 5, a cylinder lock 110 includes a cylinder 112 and a plug 114 which lock is similar to cylinder lock 46 (FIG. 3). However, cylinder lock 110 is provided with six sets of aligned holes formed in the cylinder 112 and plug 114. A first set of pins 116 and 118 with an associated spring 120 are shown assembled in one set of aligned holes of the cylinder 112 and plug 114 and are positioned relative to a shear line 121 by bit 30 of key 20. A second set of pins 122 and 124 and an associated spring 126 are assembled in another set of aligned holes and are positioned relative to shear line 121 by the sixth bit 40 of key 20. It is noted that bit 40 was not functional in the use of key 20 with cylinder lock 46 (FIG. 3).

The remaining sets of aligned openings of the cylinder 112 and plug 114 contain respective sets of pins and a spring in the same fashion as the sets of pins and spring illustrated in FIG. 5. Bits 32, 34, 36 and 38 are functional to position respective sets of pins with respect to shear line 121.

Figure 8:
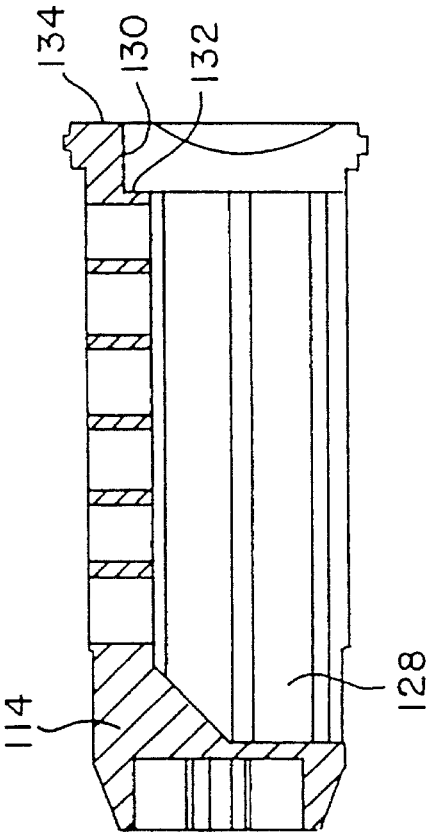
FIG. 8 is a sectional view of the plug of FIG. 5.

Plug 114 is formed with a slot 130 having a stop surface 132 formed through and spaced from a front face 134 of the plug at a location above key slot 128 as shown in FIGS. 5 and 8. Slot 130 is located to receive shoulder 42 as blade 22 of key 20 is inserted nearly fully into key slot 128. The depth of slot 130 and the location of stop surface 132 are formed so that shoulder 42 will engage the stop surface when key blade 22 is fully inserted within key slot 128. In this position, bits 30, 32, 34, 36, 38 and 40 are aligned with respective sets of tumbler pins, in the manner illustrated in FIG. 5, so that the interfacing surfaces of the pins are located along shear line 121. Plug 114 can now be rotated relative to cylinder 112.

Figure 6:
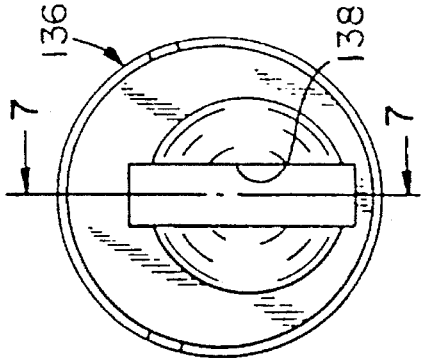
FIG. 6 is a front view of a front-face cover for the plugs of FIGS. 4 and 5.
Figure 7:
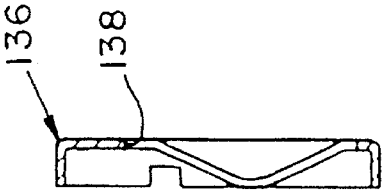
FIG. 7 is a sectional view taken along line 7—7 of FIG. 6 of the cover of FIG. 6.
Figure 4:
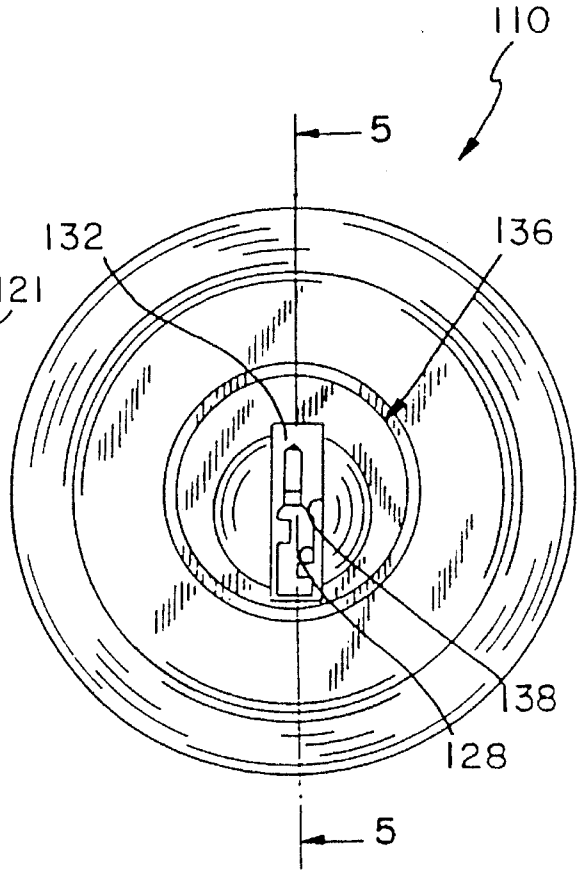
FIG. 4 is a front view of a six-pin cylinder lock.

As shown in FIGS. 6 and 7, a decorative cover 136 is provided to cover the front face 134 of plug 114. Cover 136 is formed with a window 138 which is of sufficient dimension to reveal slot 130 of plug 114 when the cover is assembled with the plug as shown in FIG. 4.

Figure 9:
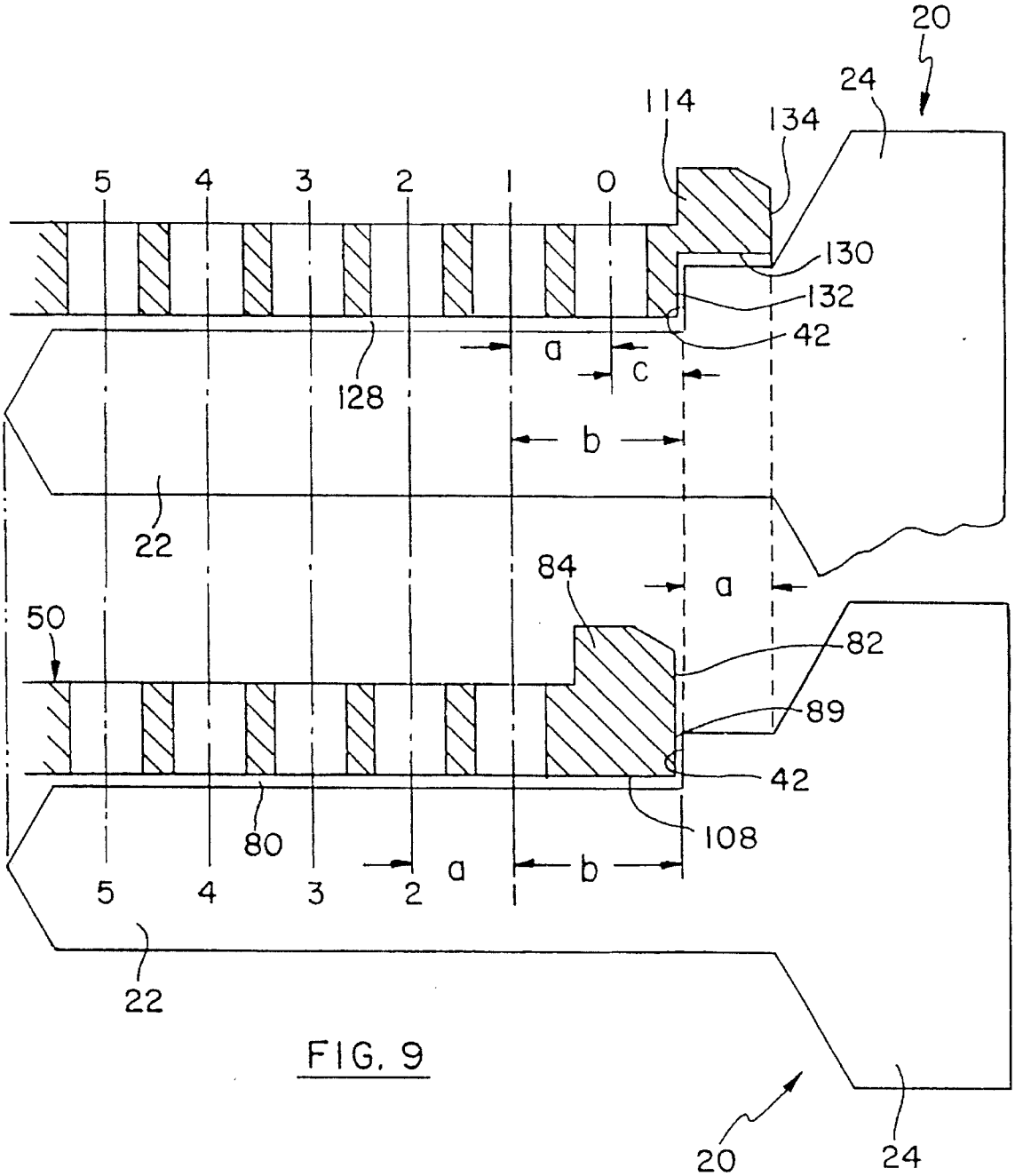
FIG. 9 is a diagrammatical view of the key of FIG. 1 in assembly with the plugs of FIGS. 3 and 5 and the relative positioning of the key therein in accordance with certain principles of the invention.

A diagrammatical illustration of key 20 in assembly with plugs 50 and 114 is illustrated in FIG. 9. It is noted that the illustration of FIG. 9 does not show particular structural features of key 20 and plugs 50 and 114 as described above.

Plugs 50 and 114 have been arranged so that the five holes of plug 50 are aligned with five of the six holes of plug 114. These five holes have been designated as "1" through "5" on the center lines thereof. The sixth hole of plug 114 has been designated as "0." In addition, the two illustrations of key 20 have been arranged so that they are in vertical alignment.

Typically, the center lines of the holes in each of the plugs 50 and 114 are spaced apart by a common dimension or distance represented by the letter "a" in FIG. 9. In the preferred embodiment, "a" is 0.15 inch. In plug 50, the dimension or distance between front face 82 and the centerline of hole "1" is represented by the letter "b" and, in the preferred embodiment, is 0.247 inch. In plug 114, the dimension or distance between front face 134 and stop surface 132 of slot 130 is represented by the letter "c" and, in the preferred embodiment, is 0.097 inch.

With respect to plug 50, distance "b" represents the spacing between front face 82 and the centerline of the first hole "1." In this arrangement, bit 40 (FIGS. 1 and 3) is facing blank surface 108. Consequently, key 20 functions in a conventional manner with respect to a cylinder lock having five sets of tumbler pins such as that illustrated in FIG. 3.

With respect to plug 114 as shown in FIG. 9, the distance between the center lines of hole "0" and hole "1" is the distance "a." In order to insure that bit 40 (FIGS. 1 and 3) will align with hole "0" when blade 22 is fully inserted within key slot 128, the depth of slot 130 must be precisely determined to engage shoulder 42 of key 20. Distance "a" is the preferred distance between holes "0" and "1" of plug 114. Distance "b" is the preferred distance between shoulder 42 of key 20 and bit 38 (FIGS. 1 and 3) which is alignable with hole "1." The distance "c" then, between stop surface 130 and the centerline of hole "0," is equal to "b" minus "a." Thus, in the preferred embodiment, "c" equals 0.097 inch. To obtain this dimensional arrangement, slot 130 must be formed with a depth equal to dimension "a" which is the same as the distance between the center lines of holes "0" through "5."

With the above-described key 20, cylinder locks of the five-pin type and the six-pin type can be installed in doors at a common facility and can have tumbler-pin combinations which permit operation of the locks by a single key.

In general, the above-described embodiments are not to be construed as limiting the breadth of the present invention. Modifications, and other alternative constructions, will be apparent which are within the spirit and scope of the invention as defined in the appended claims.

What is claimed is:

1. A key and lock system comprising a first lock including cylinder means having a central thru bore, and plug means located within said thru bore and having a key slot opening into one end thereof, said cylinder means and said plug means defining a first exterior configuration and including a selected number of equally spaced tumbler pins, a second lock including second cylinder means having a central thru bore, and second plug means located within said thru bore and having a key slot opening into one end thereof, said second cylinder means and said second plug means defining a second exterior configuration identical to said first exterior configuration so that one of said locks may replace the other of said locks, and including said selected number plus one tumbler pins having the same spacing as said spaced tumbler pins in said first lock and a key having a blow portion and a blade portion having said selected number plus one of bits for cooperating with said selected number plus one of said tumbler pins in said second lock, the bit closest to said bow portion defining a shoulder with said bow portion, said plug means, at said first lock opening, selectively configured to define stop means for said shoulder for stopping the insertion of said key with the innermost selected number of bits operatively engaging said tumbler pins in said first lock and said plug means at said second lock opening selectively configured to define stop means for said shoulder for stopping the insertion of said key with each of said bits on the key operatively engaging said tumbler pins of said second lock.

2. A key and lock system according to claim 1, wherein said first lock has five tumbler pins, said second lock has six tumbler pins, and said key has six bits.

3. A key and lock system according to claim 2, wherein said key bit closest to said key bow defines a square corner with said key bow.

* * * * *